US005197828A

United States Patent [19]

Nakanishi et al.

[11] Patent Number: 5,197,828

[45] Date of Patent: Mar. 30, 1993

[54] METHOD OF FORMING MODIFIED GROUND

[75] Inventors: Wataru Nakanishi, Machida; Shiro Nakashima, 3-1-5, Satakedai, Suita-shi, Osaka-fu, both of Japan

[73] Assignees: Shiro Nakashima, Osaka; N.I.T. Co., Ltd., Tokyo, both of Japan; a part interest to each

[21] Appl. No.: 775,761

[22] Filed: Oct. 15, 1991

[30] Foreign Application Priority Data

Aug. 14, 1991 [JP] Japan ..... 3-288248

[51] Int. Cl.[5] ..... E02D 3/12

[52] U.S. Cl. ..... 405/269; 405/263; 405/266

[58] Field of Search ..... 405/269, 266, 267, 263, 405/240, 241, 242, 258

[56] References Cited

U.S. PATENT DOCUMENTS

| | | | |
|---|---|---|---|
| 1,987,626 | 1/1935 | Klie | 405/269 X |
| 2,782,605 | 2/1957 | Wertz et al. | 405/269 X |
| 4,253,781 | 3/1981 | Fischer et al. | 405/266 X |
| 4,545,702 | 10/1985 | Sano et al. | 405/266 X |
| 4,859,119 | 8/1989 | Chida et al. | 405/263 X |
| 4,971,480 | 11/1990 | Nakanishi | 405/267 X |

FOREIGN PATENT DOCUMENTS 0161111 12/1980 Japan ..... 405/269

*Primary Examiner*—Dennis L. Taylor

*Attorney, Agent, or Firm*—Shlesinger, Arkwright & Garvey

[57] ABSTRACT

An all-round improved ground body forming device comprising a hollow outer casing with an outer metal bit at its tip end and a casing connecting section at its rear end, a casing advancer with an inner bit and a sub-bit for supporting the inner bit at its tip end and an arrowhead-shaped section to be engaged at its rear end, a casing advancer receiving and recovery device which has at its tip end an engaging section to catch the said arrowhead-shaped section and has a contracting and retracting section at an intermediate position between the main body section and the said engaging section, a hardening agent injection rod consisting of one or more air injection pipes, a hardening agent injection pipe, a high pressure water injection pipe, and a slime discharge pipe, a multiple pipe swivel joint which is provided to correspond with the said hardening agent injection rod, and a method to form an improved ground body by the said device. The said hardening agent injection rod has slime suction hole, a hardening agent jet nozzle, a monitor, a pressure sensor, and a small metal bit.

14 Claims, 14 Drawing Sheets

MJS METHOD FLOW CHART

Relation between conical shape, pressure, diameter of formed ground body

METHOD OF FORMING MODIFIED GROUND

BACKGROUND OF THE INVENTION

1. Field of the Invention

The present invention relates to a method of forming modified ground for the purpose of correcting soft grounds, forming foundations for buildings, supporting or holding a limited volume of ground, etc. and its device, and in particular, modified ground formation that can be carried out not only vertically but also horizontally as the main directions and at any angle to the land surface, namely the invention presents and modified ground formation method and a device therefor.

2. Description of the Prior Art

In the field of civil engineering, the development of forming a modified ground is particularly urgent because civil engineering must cope with the age of the deepening extension of large cities underground, underground railways at deep underground levels, etc. which will undoubtedly occur soon. In civil engineering for underground works for large cities that sit on soft alluvium deposits, the success of these works depend on whether or not the reliable formation of modified ground is feasible. Various methods for forming an modified ground have been presented since the invention of the so-called CCP method (the trade mark - 1970 by W. Nakanishi). More than a dozen new methods have been developed based on the CCP Method. All of them employ a modification of the discharge pressure, discharge volume, the use or non-use of air presented in the work method of the CCP Method, and their developments have all centered on a larger diameter of improved or modified ground. And, as mentioned above, we are now entering the age of large depth cities, large depth underground railways and city planning in bay areas which necessitate the need for a modified ground formation method which includes not only vertical works but also horizontal works, which have proved to be a challenge to the civil engineering industry.

In the prior art of forming an modified ground the so-called vertical work has been basic. With an increase in the pressure of the discharge, the quantity of discharge, and the volume of air used and other developments in this work, a large quantity of slurry is used, which causes higher ground pressure, making it more difficult for the adaptability of a modified ground body formation which requires work at a large depth and on a horizontal level. For example, in an experiment on an actual work which was at a horizontal or oblique angle to the land face, the discharge of the slime from the gap around the injection rod stopped after about 4 minutes of starting the work, and soon some ground upheaval was noticed at the area of the work. Furthermore, after a few minutes the slime gushed out at an area distant from the work area. The result was, as shown in FIG. 15 (A), the formation of an irregular-shaped modified ground mass. This is considered to be caused by insufficient discharge of the slime against the amount of the injected slurry and also by the high pressure air mixed with the slime liquid which, being different from the case of a simple air mass, does not escape horizontally but tries to escape only upwards and remains in the ground as a volume of high pressure air, forming voids with the internal pressure that is gradually raised.

Also, in the stage of drilling a hole which precedes the formation of modified ground, conventional drilling machines provide no means for protection and the machine body, bit, etc. may be damaged because it is inserted into the ground and works there. When an injection rod is used for jetting a hardening agent, it must be equipped with a bit for drilling and the injection rod must be put into the hole as it drills. Alternatively, a device which combines an injection rod and a proper drilling rod as one body must be used. This precludes the use of a special device such as a pressure sensor, etc. at the tip end of the injection rod.

The present invention aims at correcting the disadvantages of the above mentioned work methods in the prior art and at the same time attempts to review the conventional modified ground formation methods from a systematic and general standpoint in order to contribute to the current industry of civil engineering.

An objective of the present invention is to provide an improved modified ground formation device which can be adapted to be used for not only soft ground but also hard ground and includes a drilling machine, which in practice will advance to a target point in the ground by drilling, and at the target point, the modified ground formation device will remove air and slime that attempts to remain, and to form a uniform and large diameter modified ground at any angle to the ground by keeping the slime pressure in the ground constant.

Another objective of the invention is to present a smooth slime discharge mechanism.

The method for forming modified ground which achieves these objectives will be called hereinafter in general 'Metro-Jet System' (abbreviation, MJS—trade mark of the applicant of this invention).

SUMMARY OF THE INVENTION

In order to achieve the foregoing objectives, the ground is drilled by a rock drilling machine, and after drilling the hole, a hardening agent injection rod is inserted. The rod is withdrawn as it jets a hardening agent under super-high pressure, forming in the ground one or more bodies of modified ground. In this method for forming modified ground, the rear end of a casing advancer with an inner bit at its end is engaged by a casing advancer receiving and recovery device which is connectable, and can be contracted and retracted, and the casing advancer is pressed into an outer casing in the direction of drilling, to a stopper provided on the inner wall of the outer casing. Then, the casing advancer is rotated with an outer metal bit provided at the tip end of the outer casing to advance by drilling up to a specified point, and when the drilling to the target point is completed, the outer casing remains there. Next, a hardening agent injection rod is inserted into the outer casing that is left in the ground. The injection rod is provided with a hardening agent injection pipe, air injection pipe, high pressure water injection pipe, slime discharge pipe, etc. As soon as the hardening agent injection rod reaches the end of the outer casing, the latter is withdrawn until the slime suction hole on the injection rod is exposed, which completes the setting of the modified ground formation method of the invention. After this, the jetting of the hardening agent begins from the hardening agent jet nozzle while a monitor monitors the conditions in the ground. Then, the rotating or shaking and lifting of the hardening agent injection rod begins, with the slime pressure near the hardening agent jet nozzle measured by a pressure sensor provided at the tip end section of the hardening agent injection rod, and an air jet hole and/or clean water jet hole for discharging the slime are adjusted for opening according to changes in the slime pressure in the ground in order to keep the slime pressure in the ground substantially constant. This is an outline of MJS for forming an improved ground body.

The present invention presents the following advantages.

By using the outer casing, safety of the drilling machine and certainty of a drilled hole that is given by the cooperative works of the outer metal bit installed at the tip end of the casing and the inner bit at the tip end of the casing advancer positioned in the outer casing are provided, and at the same time it is possible to realize uniformity of the slime pressure in the ground by employing the monitor, pressure sensor, slime suction hole, etc.

DETAILED DESCRIPTION OF THE PREFERRED EMBODIMENT

The embodiments of the invention will be explained with reference to the accompanying drawings.

Figure 1:
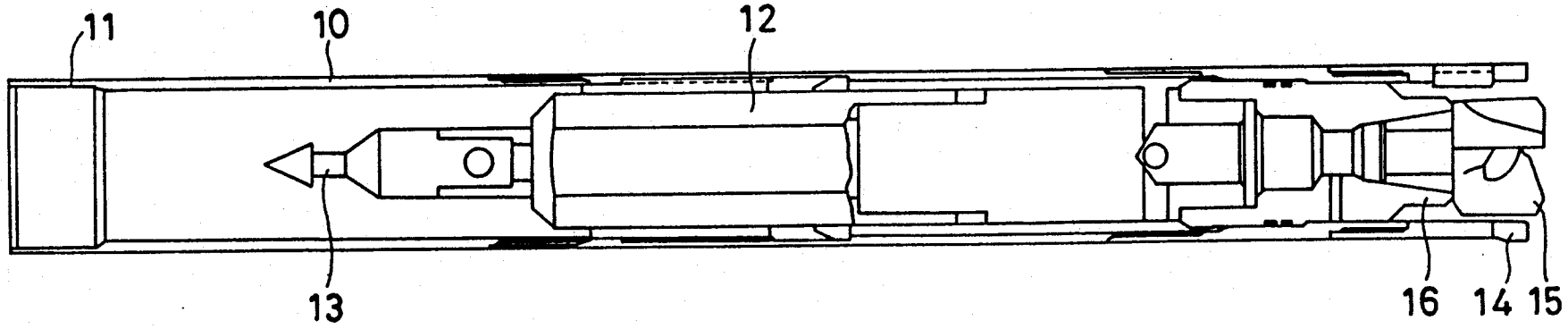
FIG. 1 is the casing advancer inserted into the outer casing according to the invention, FIG. 2 (A) is an embodiment of the casing advancer receiving and recovery device of the invention, FIG. 2 (B) is a plan view of the inner bit according to the invention.

FIG. 1 shows an outer casing (counter rod) 10 into which a casing advancer 12 is inserted.

The tip end of the outer casing 10 has an outer metal bit 14 and at the rear end it has a casing connecting section 11 so as to be able to extend as needed. The casing is a member with a length as required to make transportation and handling easy. On the other hand, the casing advancer 12 has at its tip end an inner bit 15 for drilling holes and a sub-bit 16 for supporting and supplementing the inner bit 15, and at its rear end has a section 13 to be engaged that is shaped like an arrowhead. A mechanism is provided by which the whole of the casing advancer 12 or the inner bit 15 and its support only can rotate selectively in one direction. Since the outer casing 10 can sometimes be rotated by the rotation mechanism of a boring machine 48 (FIGS. 11 and 12) that is supported on the land or in outer space, the casing advancer 12 only or with the outer casing 10 is rotated to advance by drilling. In this case they can rotate in the same direction but they can also be rotated in the opposite direction.

Figure 2A:
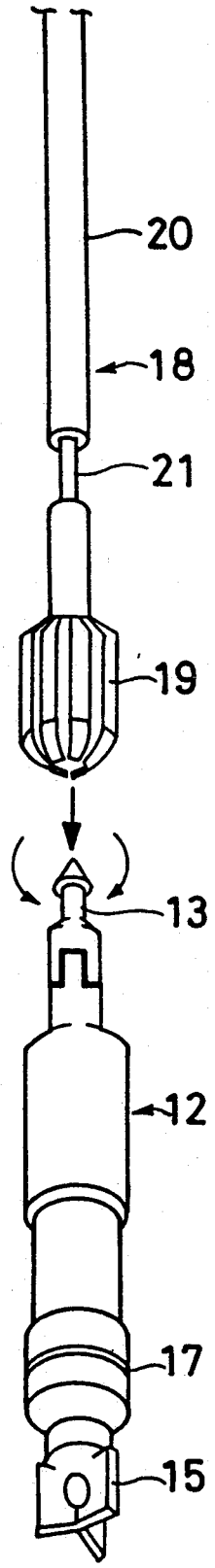

The casing 10 and the casing advancer 12 advance together, therefore, by drilling in order to form a drilled hole up to a specified position. In this advancing the outer casing 10 is suitably connected to the casing connection section and at the rear end of the casing advancer 12, as shown in FIG. 2(A), the section 13 to be engaged is connected to the casing receiving and recovery device 18 which has an engagement section 19 with the section 13 caught by the device 18. Furthermore, since the advancer receiving and recovery device 18 has the main body section 20 and a contracting and retracting section 21, it can be contracted or retracted with the casing 10 to a target point.

Figure 2B:
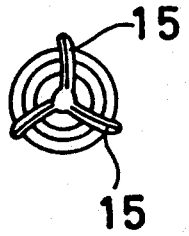

The shape of the inner bit 15 provided at the tip end of the casing advancer 12 can be one of various shapes. In FIG. 2(A) and FIG. 2(B) a three-blade bit is shown as an example. The inner bit 15 is subject to large pressure from the ground on which it is working so that its support section is constructed to be strong. An 0-ring 17 is provided in addition to the mechanism to rotate against the pressure.

Furthermore, it is desirable that the inner bit 15 project ordinarily a little further than the outer metal bit 14 at the tip end section during the drilling operation.

Figure 3:
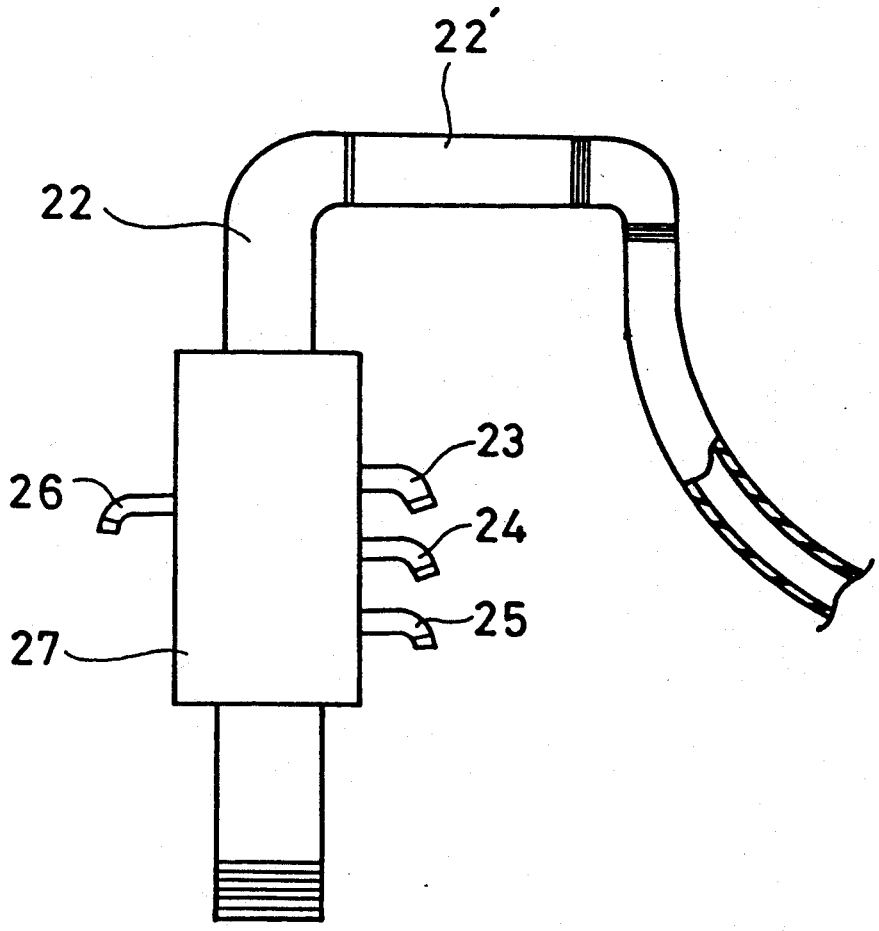
FIG. 3 is a schematic view of the multiple pipe swivel joint.

FIG. 3 is a schematic view of a multiple pipe swivel joint 27 which comprises a hardening agent injection inlet 23, high pressure water injection inlet 25, air injection inlet 24, air injection 26, and slime discharge outlet 22. This multiple pipe swivel joint 27 is, therefore, connected to a hardening agent injection rod. In this embodiment the air injection inlets 24 and 26 are respectively used for different purposes so that they are constituted of different injection pipes, and the swivel joint 27 is, therefore, a composite pipe of five pipes. This is only one embodiment and a composite pipe of 4 pipes, 3 pipes, etc. can be used.

The above mentioned slime discharge outlet 22 is connected to a slime discharge outer pipe 22', then the slime is discharged to a slime disposal machine through a rubber hose, etc.

Figure 4:
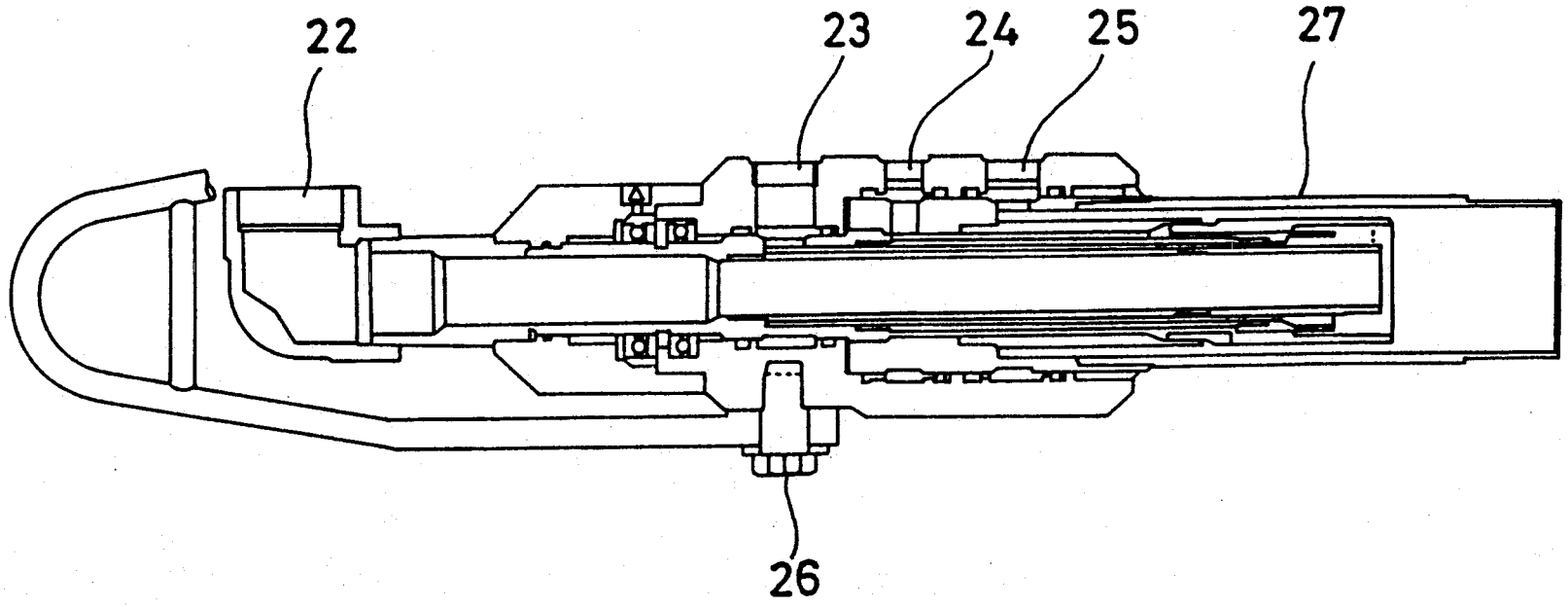
FIG. 4 is a cross section of the multiple pipe swivel joint.

FIG. 4 shows the cross section of a swivel joint which corresponds to the multiple pipe swivel joint 27 shown in FIG. 3 although their shapes are not identical.

In FIG. 4 the numerals 23, 24, 25 and 26 denote respectively the above mentioned inlets, and the numeral 22 is the slime discharge outlet 22. Additionally, this multiple pipe swivel joint 27 comes into contact with the injection rod end second section of FIG. 6, and further with the hardening agent injection section of FIG. 5 and FIG. 7.

Figure 5:
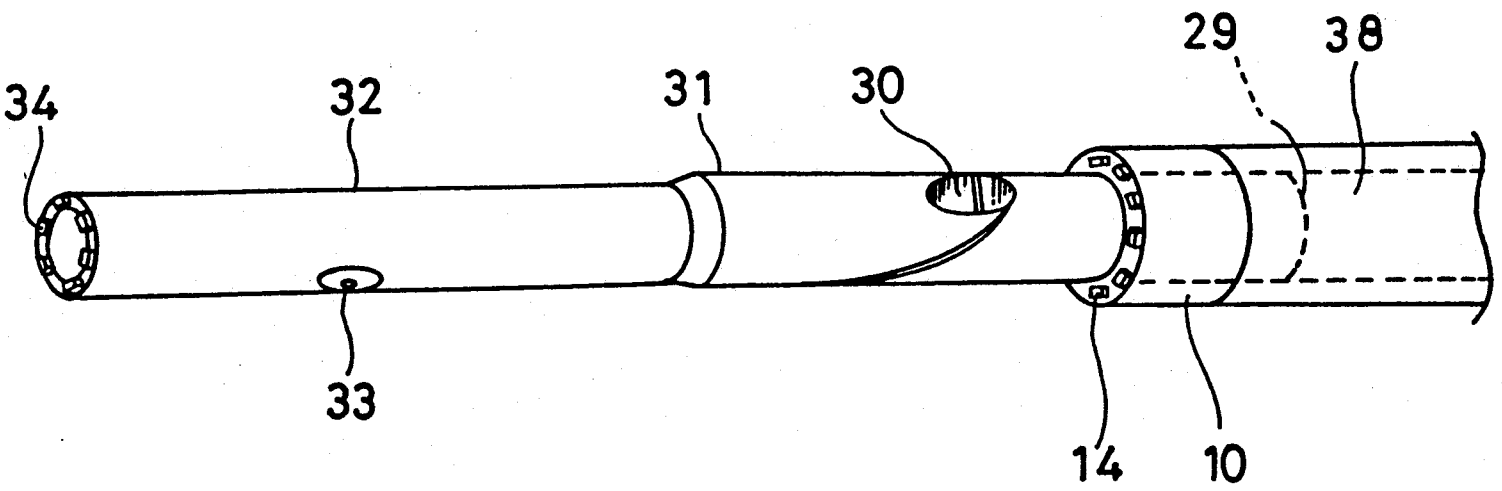
FIG. 5 is a schematic view of the hardening agent injection rod with its tip end section being exposed from the tip end section of the outer casing.

FIG. 5 shows schematically that the tip end of the hardening agent injection rod is exposed from the tip end section of the outer casing 10.

In FIG. 5 the tip end section of the hardening agent injection rod consists of an injection rod end first section 32 with a small metal bit 34 and an injection nozzle 33, and an injection rod tip end second section 31 which has a slime suction hole 30. The rear end section of this tip end second section 31 has a connecting section 29 so that the rod can be extended to any desired length. In FIG. 5 the hardening agent injection rod is inserted into the outer casing 10, which shows that the drilling is finished by the drilling machine as explained in FIG. 1 and FIG. 2, and the outer casing 10 remains in the hole and the casing advancer is recovered by the casing advancer receiving and recovery device 18 and the injection rod 38 is inserted in order to inject the hardening agent. When the hardening agent injection rod 38 reaches the tip end section of the outer casing 10 that has remained in the hole, the outer casing 10 is withdrawn to the point where the slime suction hole 30 is exposed and the setting for the hardening agent injection is completed. The state that the hardening agent rod 38 is in the outer casing 10 is the same as the state that the casing is in the outer rod and the injection rod 38 is in the inner rod, which means that there are duplex rods, and normally this state provides a constitution which is slender at the end and stout at the root and as a whole it offers a strong hardening agent injection rod or device.

A small metal bit 34 that is provided at the tip end first section 32 of the hardening agent injection rod is normally used for drilling but when it is inserted into the outer casing 10, it removes obstacles within, or it has the function of advancing by drilling, a short distance as needed.

The slime suction hole 30 has a mechanism (not shown) which freely adjusts the size of the opening to that required by the slime generation quantity.

Figure 6:
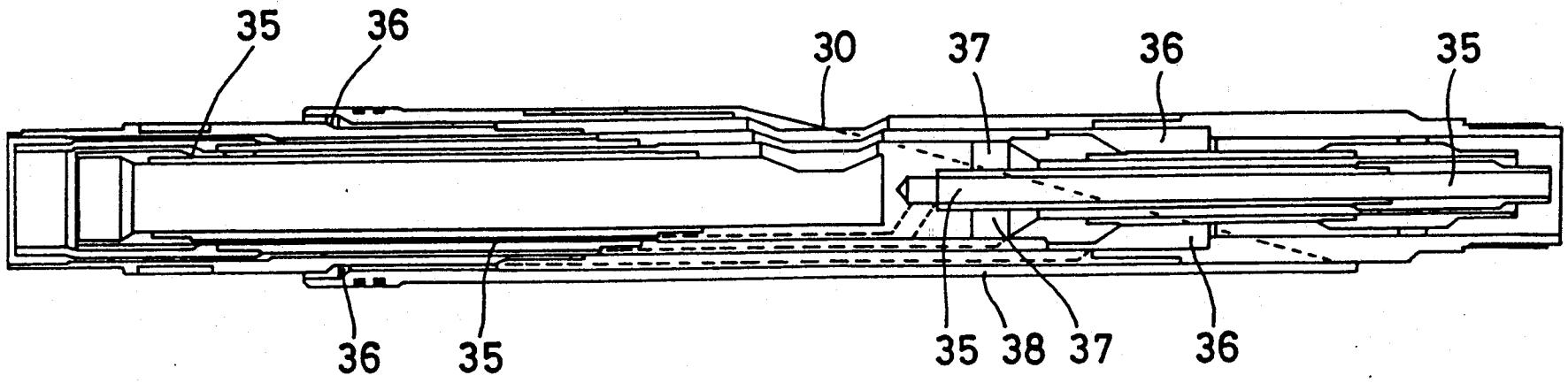
FIG. 6 is a cross section of the tip end section of the hardening agent injection rod second section, FIG. 7 (A) is a schematic cross section of the tip end of the hardening agent injection rod, FIG. 7 (B) is the cross section taken on the line X—X' of FIG. 7 (A)

FIG. 6 shows the cross section of the tip end section 31 of the hardening agent injection rod. In this figure, a slime suction hole 30 is provided on the side wall of the hardening injection rod 38. It also has a slime discharge pipe 47 which comes into contact with the rod 38 in order to discharge the slime to the internal center of the rod. The inside of the hardening agent injection rod 38 has a hardening agent injection pipe 35, air injection pipe 36, and a high pressure water injection pipe 37 respectively.

The rod in FIG. 6 is an embodiment of the invention in which a quadruple pipe is used. FIG. 6 is not necessarily the same as FIG. 7 in order to show other embodiments with a slime suction hole, injection nozzles, etc. FIG. 6 shows an embodiment which has a slime suction hole 30 which has neither a clean water injection hole 40 and/or air injection hole 41.

Figure 7A:
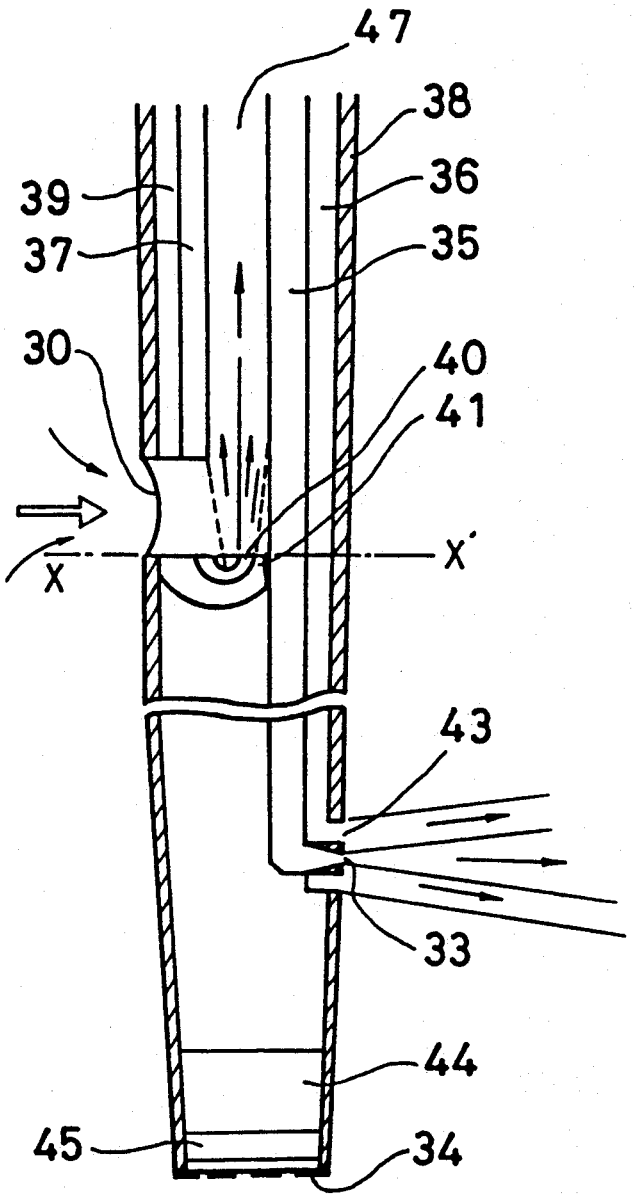

FIG. 7(A) is a schematic cross-sectional view of the tip end section of the hardening agent injection rod 38.

In FIG. 7(A) the hardening agent injection rod 38 has a hardening agent injection pipe 35, high pressure water injection pipe 37, air injection pipes 36 and 39 as above and it is apparent from the figure that the slime discharge pipe 47 is in the center of the hardening agent injection rod 35. The slime that is sucked from the slime suction hole 30, flows into this slime discharge pipe 47. The slime is sucked from the slime suction hole 30 by the energy from the pressure in the ground which is accumulated in the slime itself by the injection pressure of the hardening agent and the air that encircles the hardening agent, and further, the slime is injected above the slime discharge pipe 47 and discharged to the outside by the clean water and/or air jetted from the clean water jetting hole and/or the air jetting hole that is provided on the side wall and at the lowest section of the said slime discharge pipe 47.

At a great depth underground, from which the slime cannot be discharged smoothly by the pressurised energy in the ground at that depth, and the jetting pressure from the jet holes 40 and 41 auxiliary jet holes (not shown) for jetting clean water and/or air, are provided at more than two locations on the wall on the slime discharge side.

Figure 7B:
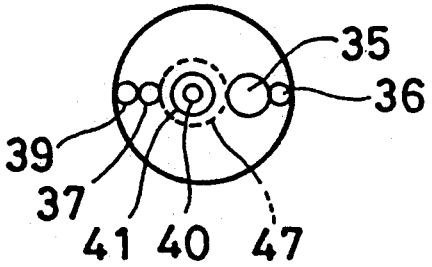

FIG. 7(B) is a cross-section taken on line X—X' of FIG. 7(A). According to FIG. 7(B) an embodiment is shown in which a clean water jet hole 40 and an air jet hole 41 are provided at the lowest section of the slime discharge pipe 47.

When the slime that is sucked from the slime suction hole 30 climbs higher than the jet holes 40 and 41, the slime is jetted from below the jet hole to above the slime discharge pipe 47. The slime is now not only jetted upwards but also the pressurized energy in the ground is supplemented by the jet, and the slime jet force and slime quantity increases.

On the other hand, the tip end section of the hardening agent injection rod 38 (corresponding to the tip end first section 32 in FIG. 5) is provided with an air jet nozzle 43 which encircles the hardening agent jet nozzle 33, and further, at the tip end of the nozzle 43, a monitor 44, pressure sensor 45, and an all metal bit 34 are provided. However, the monitor 44 is usually provided at the positions where the nozzle 33 and nozzle 43 are provided.

Figure 8:
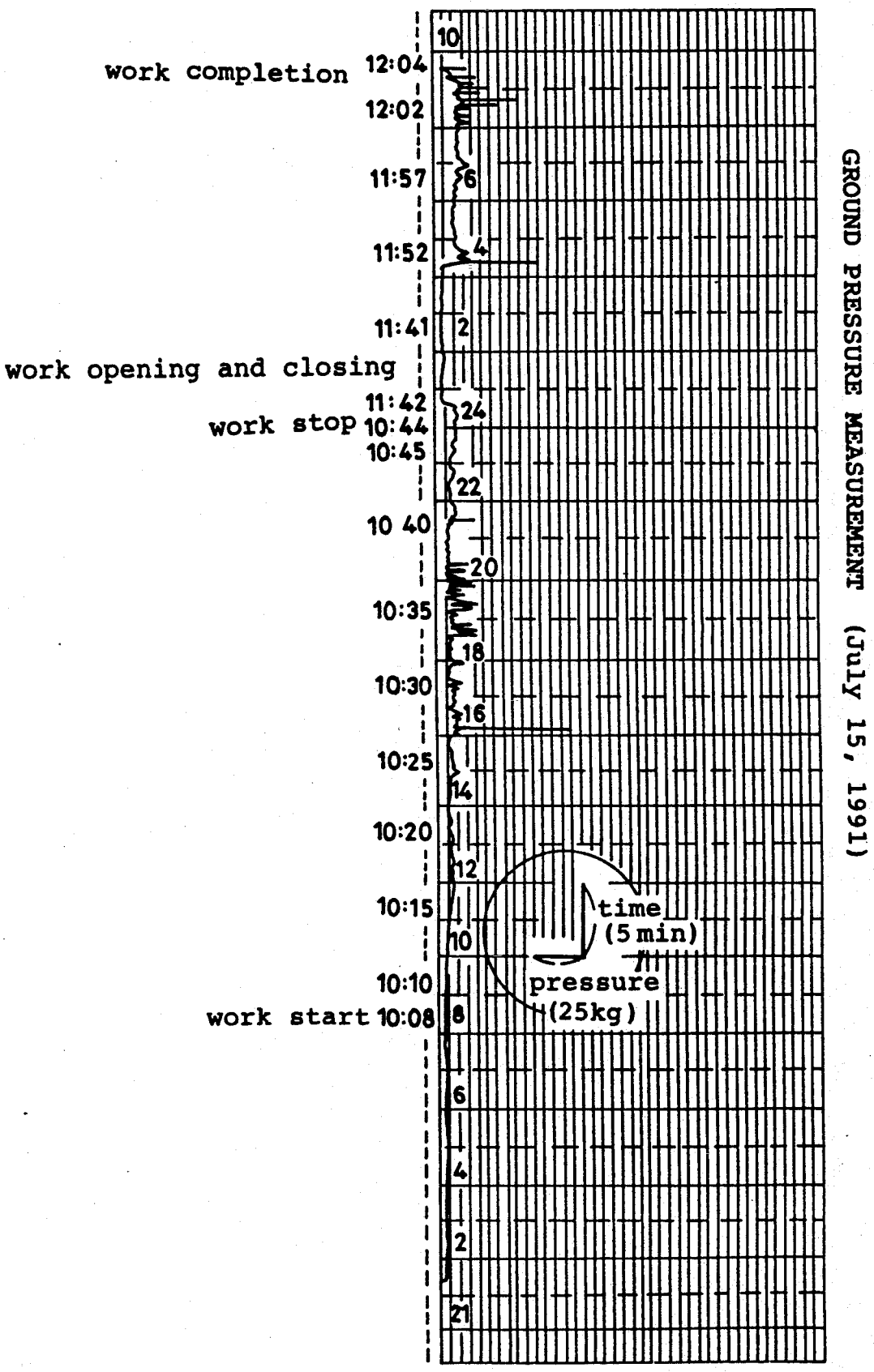
FIG. 8 is a graphic representation of the results of the measurement of the pressure in the ground.

FIG. 8 shows the results of measurements made of ground pressure in a work test which was made on Jul. 15, 1991.

In FIG. 8 a series of pressure in the ground from the start of the test to the end of the test are shown. In comparison with the results of a prior test, an extreme amplitude in the pressure is not found. This is because a pressure sensor 45 provided at the tip end of the hardening agent injection rod 38 measured pressure continuously and according to the ground pressure, the quantity of the injected hardening agent, or the quantity of the injected air, was adjusted so that it was possible to keep the slime pressure in the ground substantially constant. If the ground pressure can not be kept constant, a homogeneous modified ground body 52 (as shown in FIG. 15(A)) cannot be formed. In the graph of FIG. 8, the spots where the peak of the amplitude is large, represent the switching of the injection rod, switching of the injection pressure, or other changes.

Figure 9:
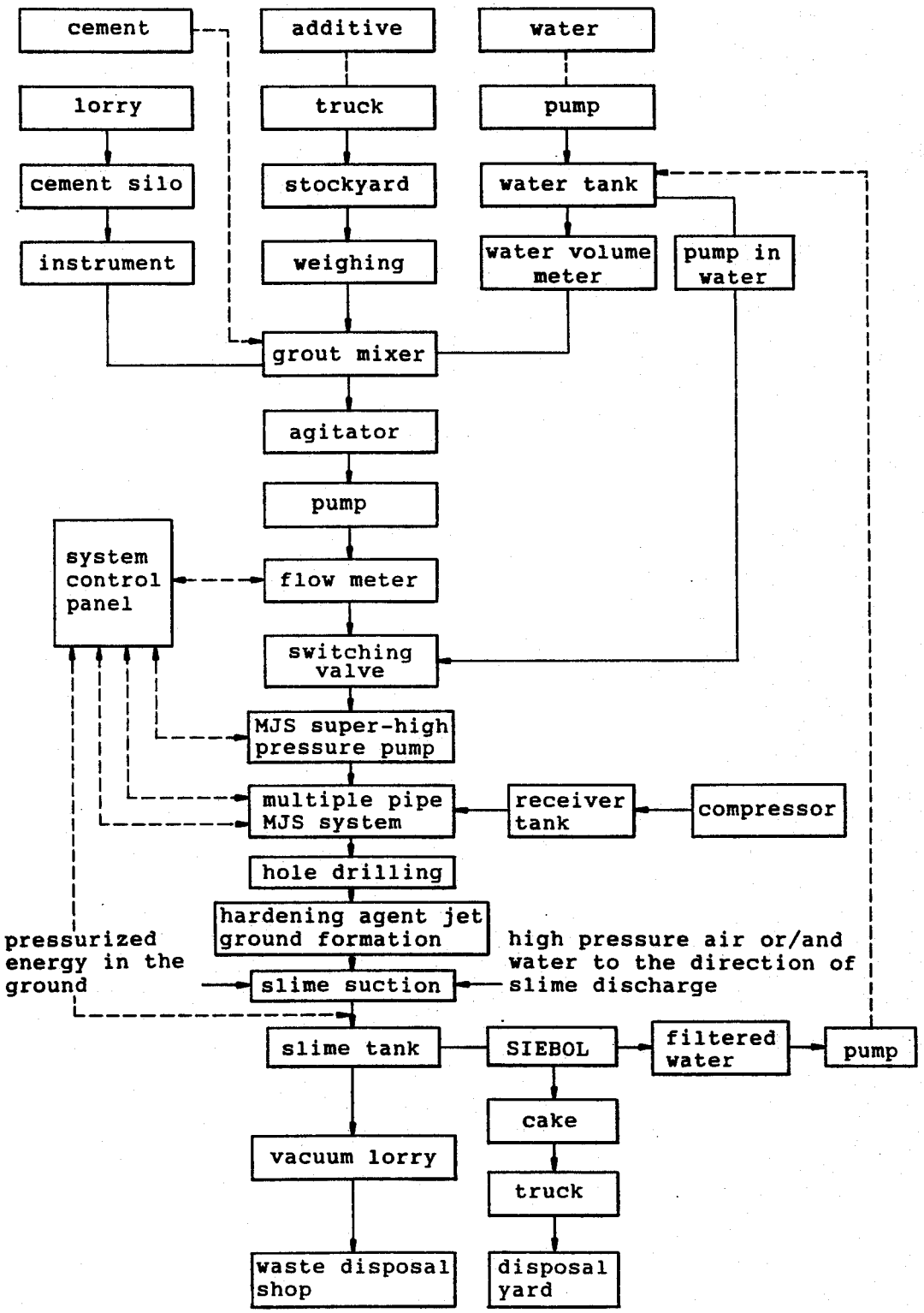
FIG. 9 is a flow chart of the MJS work method.

FIG. 9 is a flow chart for the MJS method of the invention.

The outline of the MJS method will be explained with reference to the flow chart in order that the overall flow of the method may be understood.

Firstly, basic materials such as a certain amount of cement, additive and water, are agitated in a grout mixer, and the mixture is sent to a switching valve through a weighing machine from the mixer. By opening the switching valve, the mixture is sent to the hardening agent injection rod, namely the mixture is sent to the multiple pipe the MJS system provided with the abovementioned various mechanisms under pressure by an MJS super-high pressure pump. In this operation, not only the MJS super-high pressure pump in MJS system but also the injection rod with the multiple pipe, flow rate meter, clean water jetting hole and/or jet hole for slime suction, etc., are controlled by a system control panel. Under this control, the ground which is to be modified is drilled first by a drilling machine then afterwards the pressure in the ground is monitored and measured and the hardening agent is jetted with the slime being sucked.

The slime, which may give rise to environmental pollution and various other problems, is discharged from the discharge pipe to a slime tank. The slime is, in the MJS system of the invention, filtered through a filtering machine with the trade name of 'SIEBOL'. The cakes obtained from this filtering process are sent to a subcontractor for their disposal. On the other hand, the filtered water is re-used in the present ground improvement work by a pump.

Figure 10:
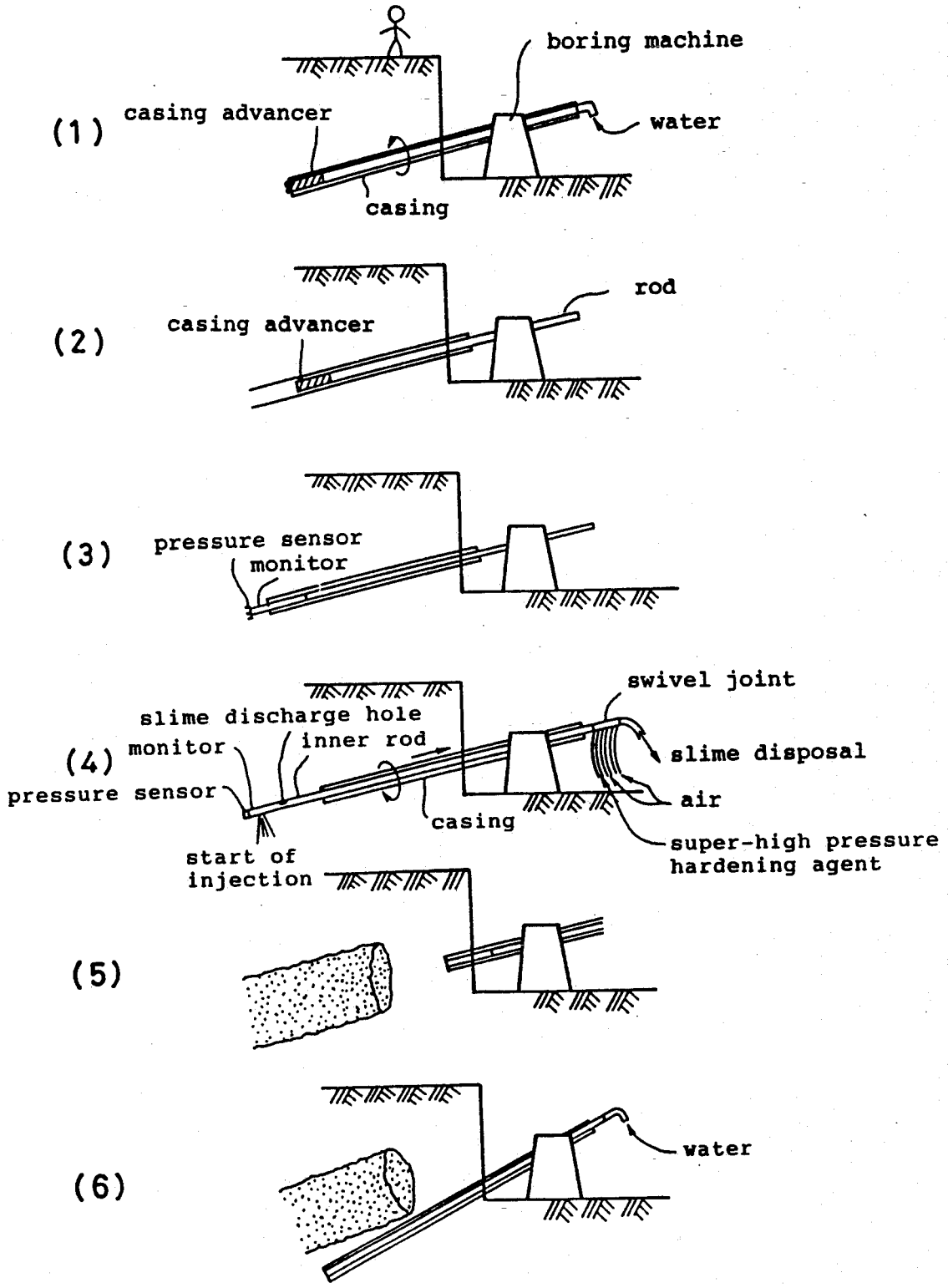
FIG. 10 is a graphic representation showing the flow of the works in an embodiment of the invention.

FIG. 10 is a schematic view of the all-round ground body improvement work flow at an angle of 45° to the land face.

FIG. 10(1) shows the drilling of the casing advancer that is inserted into the outer casing and supported and rotated by a boring machine. The rotation of the casing and the casing advancer when they are drilling a hole together, has been explained in the foregoing, and usually water is poured into the drilled hole.

FIG. 10(2) shows the casing advancer being received and recovered by the casing advancer receiving and recovery device with the casing remaining in the ground.

FIG. 10(3) shows the insertion of the hardening agent injection rod, provided with the pressure sensor and the monitor, into the casing that is left in the ground. The casing is withdrawn a little, so that the slime suction hole is exposed, before the hardening agent is jetted out. After this, as shown in FIG. 10(4), the pressure sensor, that is installed at the tip end of the hardening agent injection rod, measures the pressure in the ground and the conditions of the hardening agent jetting are monitored, and the homogeneous hardening agent injection is continued with the slime being sucked from the slime suction hole. The hardening agent injection rod and the casing are then withdrawn as they rotate in a specified direction until they reach the modified ground body formation range.

FIG. 10(5) shows the casing and the hardening agent injection rod that are withdrawn after the formation of an modified ground body. When a plurality of modified ground bodies are to be formed continuously, the abovementioned series of modified ground body formation steps must be carried out.

Figure 11:
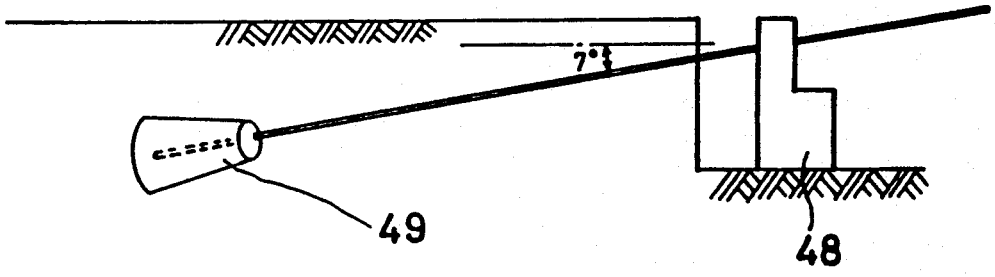
FIG. 11 is an example of the work for forming a modified ground body which is conical in shape, FIG. 12 (A) is an example of the work for a semi-conical modified ground body formation, FIG. 12 (B) is a schematic view of an example of the horizontal work in which semi-conical improved ground bodies are continuously formed.

FIG. 11 shows an example of the work in which a conical improved ground body 49, in place of the cylindrical modified ground body formation shown in FIG. 10, is provided.

Figure 12A:
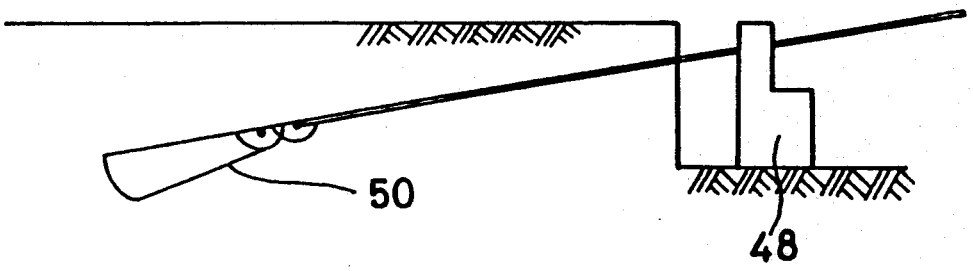

FIG. 12(A) shows an example of the work to form a semi-conical modified ground body 50.

Figure 12B:
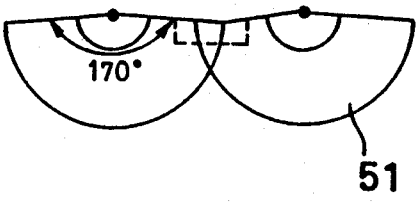

Furthermore, in FIG. 12(B), a continuous formation of semi-conical modified ground bodies are shown schematically. The method of the invention to form modified ground bodies is thus capable of forming an modified ground suitable for its purpose.

Additionally, in the overlapping sections of the semi-conical modified ground bodies 51 in parallel as shown in FIG. 12(B) it has been proved by the work execution experiment that the modified ground body formation with a uniform strength as in the other parts is provided.

Figure 13:
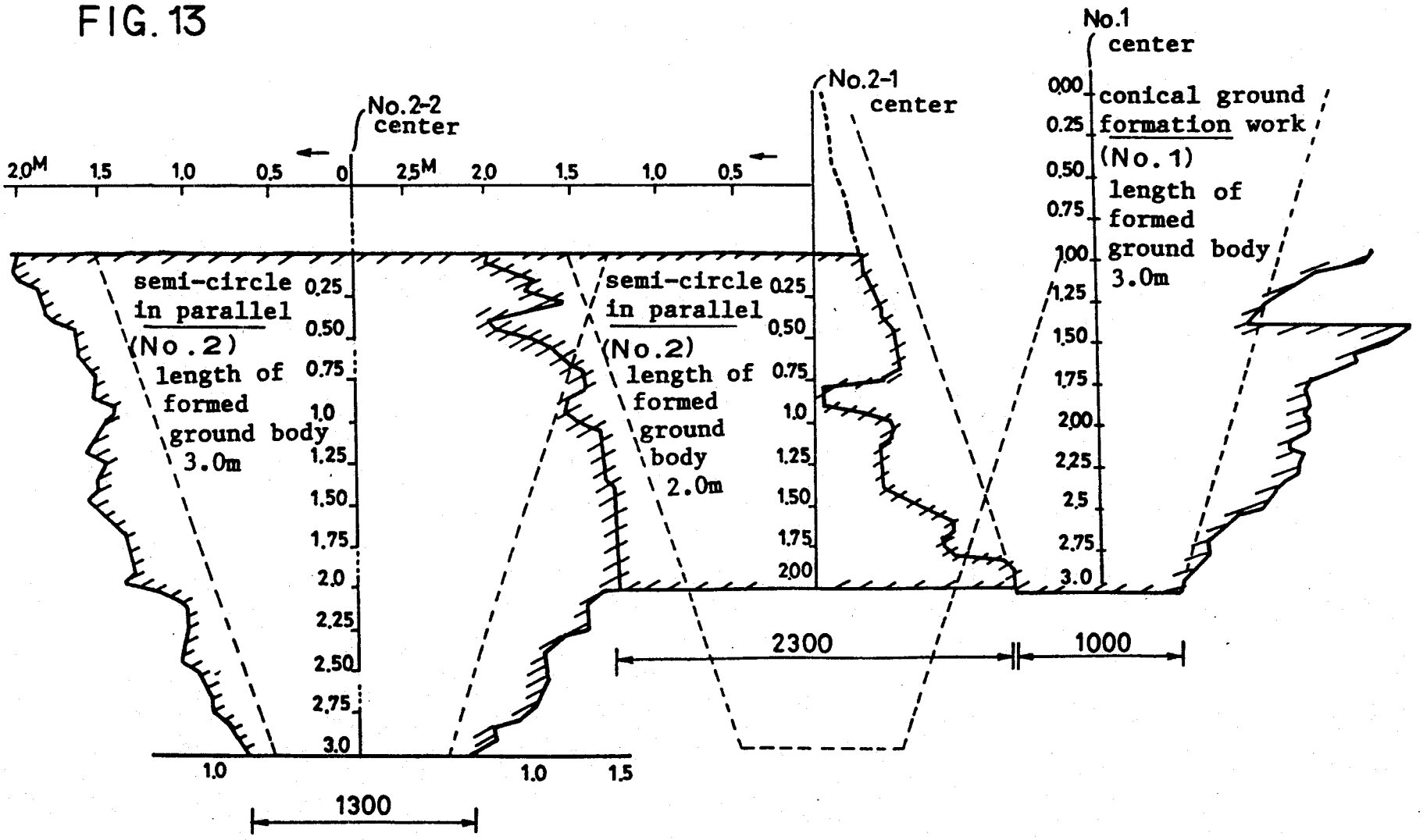
FIG. 13 is a schematic plan view of the horizontal modified ground body formation work for conical improved ground bodies in parallel.

FIG. 13 is a schematic plan to show the results of horizontal work in which conical modified ground bodies are formed in parallel.

FIG. 13 gives an idea of the shape, the size of the diameter etc. of the abovementioned overlapping sections and modified ground bodies.

Figure 14:
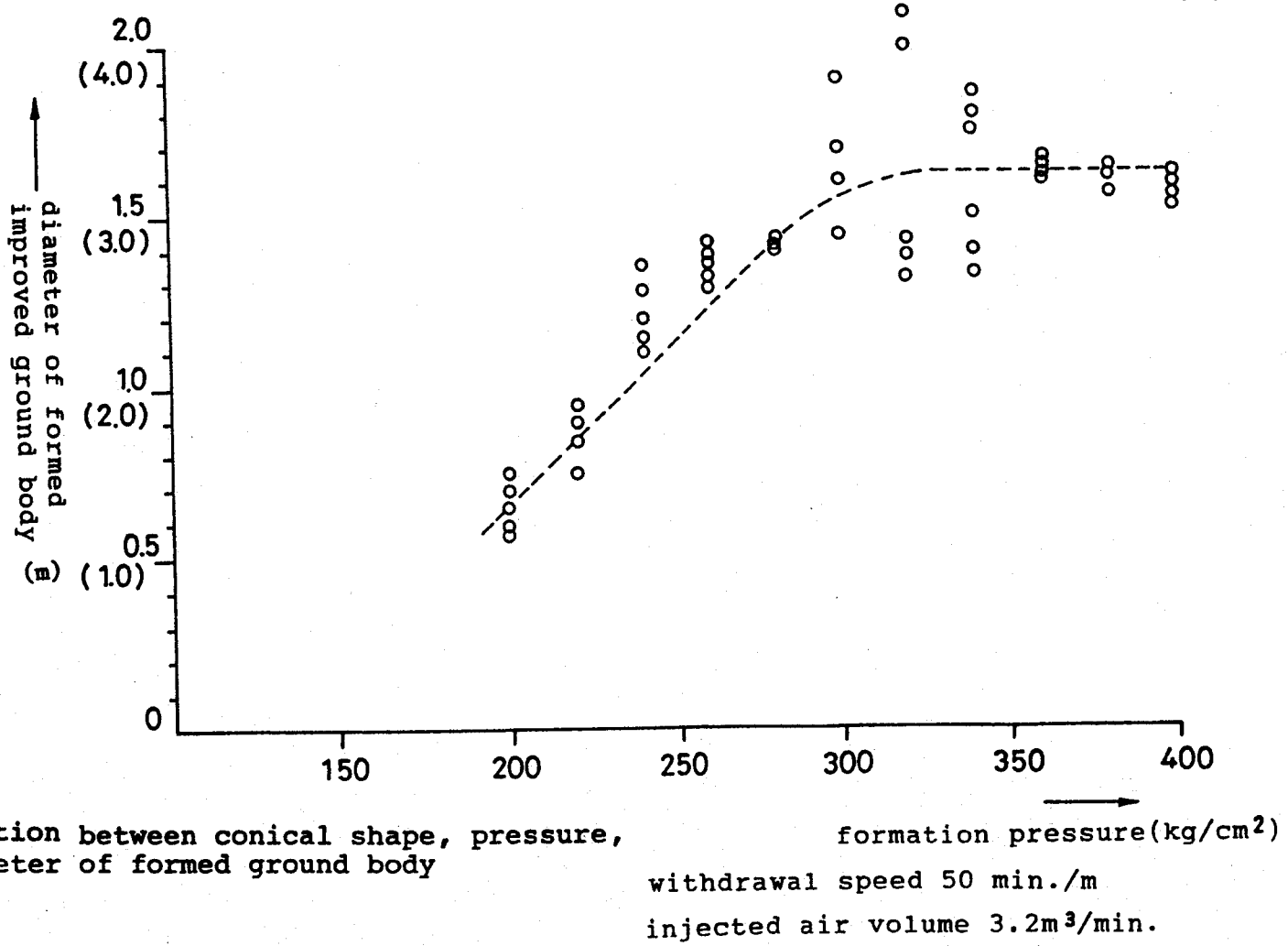
FIG. 14 is a graph showing the relation between the pressure developed in forming a cone-shaped modified ground body and the diameter of the formed modified ground body, FIG. 15 (A) is a schematic cross-sectional view of an modified ground body formed in the prior art, and FIG. 15 (B) is a schematic cross-sectional view of a modified ground body formed as an embodiment of the invention.

FIG. 14 is a graph that shows the relation between the pressure and the formed modified ground body diameter in the formation of conical improved modified ground bodies.

In the ground formation in FIG. 14, an air volume of 3.2 $m^3$ per minute was injected and the withdrawal speed of the tube was one meter per 50 minutes. When the pressure used in the modified ground formation is high, the diameter of the modified ground body is usually large. In order to form a uniform modified ground body which satisfies the purpose of its use, the ground formation is executed by maintaining a balance between the formation pressure and the formation shape, which is different from the prior art.

Figure 15B:
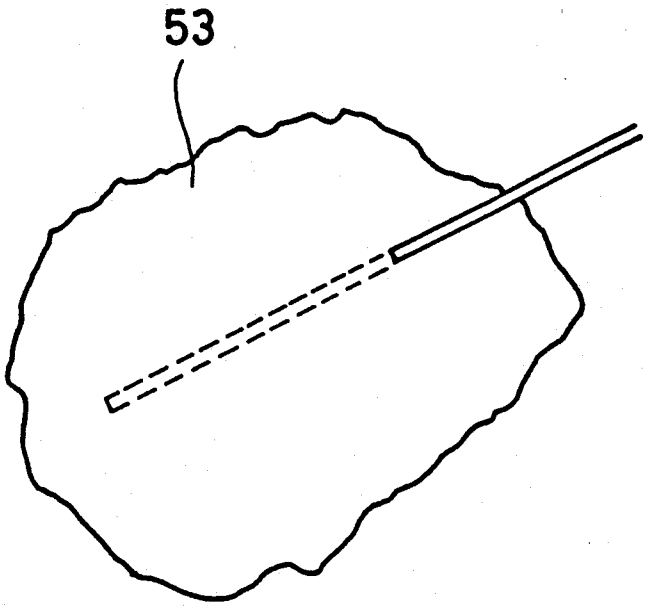
Figure 15A:
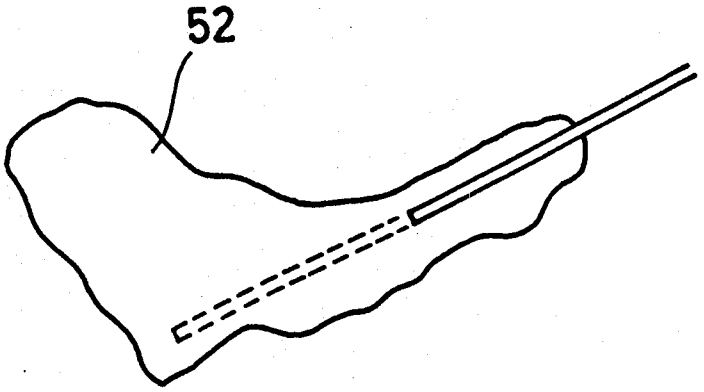

In the work execution for the above embodiments, the formed modified ground body is not like the ground body 52 formed by the prior art in FIG. 15(A), but like the modified ground body 53 which is uniform as shown in FIG. 15(B).

In FIG. 15(A) the reason for the recess in the center of the modified ground body 52 is that the pressure in the ground was not uniform probably due to the air and the slime that were left in that area.

According to the present invention, it is possible firstly, to form modified ground body at a large underground depth and in various conditions and aspects, namely it is possible to form an modified ground body for the worked ground.

At any angle, the slime that is sucked and discharged through the slime suction hole and the injection pressure in the ground, can be kept uniform and constant so that it is possible to form modified ground as desired. In an extreme case in which the ground directly above the modified ground formation device has to be improved, a suitable discharge of the slime is provided by operating a mechanism to adjust the opening of the slime suction hole in order to prevent an excessive discharge of the slime along the rod after the injection of the hardening agent.

As explained above, one reason for the possibility of the modified ground formation by the invention is that the casing advancer is used with the outer casing and a drilled hole with a certain diameter is formed and the casing which was used for drilling the hole is left again for injecting the hardening agent in the modified ground formation. This means that in addition a drilled hole of a certain diameter can be definately formed.

Secondly it is possible to form a uniform, large diameter modified ground body by providing an effective injection of the hardening agent with the injection controlled from the land surface by sucking and removing the sludge which contributes to reduce the effect of modified ground formation and causes environmental pollution.

With the modified ground formation method of the invention, it is possible to provide a modified ground formation which is simple and executed quickly and exactly and is possible to achieve a high efficiency from a cost standpoint.

What is claimed is:

1. A method of forming modified ground, comprising:

a) drilling a hole in the ground with a drilling machine of the type having a rotatable outer casing and an outer metal bit provided on a tip end section of the outer casing, a casing advancer inserted in the outer casing, and the casing advancer including a tip end having an inner bit and a rear end engageable by a casing advancer receiving and recovering device;

b) said drilling being performed by the outer metal bit and the inner bit;

c) said drilling being performed until a target point for forming modified ground is reached;

d) retracting the casing advancer after said drilling has reached the target point;

e) said retracting being performed by the casing advancer receiving and recovery device engaging the rear end of the casing advancer;

f) leaving the outer casing in the ground while said retracting is being performed;

g) inserting a hardening agent injection rod into the outer casing, the hardening agent injection rod being of the type having a tip end section, a hardening agent injection pipe, an air injection pipe, a high pressure water injection pipe, an airjet hole, a slim discharge pipe, a slime suction hole disposed rearwardly of the tip end section, and a pressure monitor disposed adjacent the tip end section;

h) withdrawing the outer casing after the hardening agent injection rod reaches the tip end section of the outer casing, said withdrawing of the outer casing continuing until the slime suction hole is exposed;

i) initiating a hardening agent jet from a jet nozzle on the hardening agent injection pipe;

j) initiating rotating, shaking, and lifting of the hardening agent injection rod;

k) monitoring a slurry pressure in the vicinity of the hardening agent jet nozzle by a pressure sensor provided on the tip end section of the hardening agent injection rod; and l) maintaining the slurry pressure substantially constant by adjusting one of an air jet hole on the air injection pipe and a clean water jet hole on the high pressure water injection pipe for discharging slime through the slime suction hole and the slime discharge pipe according to changes in the slurry pressure measured by the pressure sensor.

2. A method of forming modified ground as defined in claim 1, wherein:

a) said retracting is performed by opening and closing mechanisms of a catching section disposed at the tip end of the casing advancer receiving and recovery device for unifying the engageable rear end of the casing advancer with the casing advancer receiving and recovery device.

3. A method of forming modified ground as defined in claim 1, wherein:

a) said retracting is performed by an engaging section disposed on said casing advancer receiving and recovery device, a main body section being disposed rearwardly of the engaging section, an intermediate section being disposed between the engaging section and the main body section, the intermediate section being retractable for retracting the casing advancer, and the main body section being connectable to at least one member for extending the length thereof.

4. A method of forming modified ground as defined in claim 1, wherein:

a) said drilling is performed by the outer metal bit provided on the tip end section of the outer casing and the inner bit provided on the tip end of the casing advancer rotating in one of the same and opposite directions of rotation.

5. A method of forming modified ground as defined in claim 1, further comprising:

a) jetting at least one of clean water and air under high pressure for smoothly discharging slime upwardly through the slime discharge pipe, at least one of the air jet hole and the clean water jet hole being provided at an inner wall of the slime suction hole.

6. A method of forming modified ground as defined in claim 1, wherein:

a) said maintaining the slurry pressure substantially constant is carried out by providing at least one of a clear water jet hole and an air jet hole for jetting at least one of clean water and air under high pressure at at least one place in a wall of the slime discharge pipe.

7. A method of forming modified ground as defined in claim 1, wherein:

a) during the step of initiating a hardening agent jet the jet nozzle of the hardening agent injection rod and the slime suction hole are each disposed at a distance from the outer casing and are each exposed.

8. A method of forming modified ground, comprising:

a) drilling a hole in the ground with a drilling machine of the type having a rotatable outer casing and an outer metal bit provided on a tip end section of the outer casing, a casing advancer inserted in the outer casing, and the casing advancer including a tip end having an inner bit and a rear end engageable by a casing advancer receiving and recovering device;

b) said drilling being performed until a target point for forming modified ground is reached;

c) retracting the casing advancer after said drilling has reached the target point;

d) said retracting being performed by the casing advancer receiving and recovery device engaging the rear end of the casing advancer;

e) leaving the outer casing in the ground while said retracting is being performed;

f) inserting a hardening agent injection rod into the outer casing, the hardening agent injection rod being of the type having a tip end section, a hardening agent injection pipe, an air injection pipe, a high pressure water injection pipe, an airjet hole, a slim discharge pipe, a slime suction hole disposed rearwardly of the tip end section, and a pressure monitor disposed adjacent the tip end section;

g) withdrawing the outer casing after the hardening agent injection rod reaches the tip end section of the outer casing, said withdrawing of the outer casing continuing until the slime suction hole is exposed;

h) initiating a hardening agent jet from a jet nozzle on the hardening agent injection pipe;

i) initiating rotating, shaking, and lifting of the hardening agent injection rod;

j) monitoring a slurry pressure in the vicinity of the hardening agent jet nozzle; and, k) maintaining the slurry pressure substantially constant by adjusting one of an air jet hole on the air injection pipe and a clean water jet hole on the high pressure water injection pipe for discharging slime through the slime suction hole and the slime discharge pipe according to changes in the slurry pressure measured by the pressure sensor.

9. A method of forming modified ground as defined in claim 8, wherein:

a) said retracting is performed by opening and closing mechanisms of a catching section disposed at the tip end of the casing advancer receiving and recovery device.

10. A method of forming modified ground as defined in claim 8, wherein:

a) said retracting is performed ban engaging section disposed on said casing advancer receiving and recovery device, a main body section being disposed rearwardly of the engaging section, an intermediate section being disposed between the engaging section and the main body section, and the intermediate section being retractable for retracting the casing advancer.

11. A method of forming modified ground as defined in claim 8, wherein:

a) said drilling is performed by the outer metal bit provided on the tip end section of the outer casing and the inner bit provided on the tip end of the casing advancer rotating in one of the same and opposite directions.

12. A method of forming modified ground as defined in claim 8, further comprising:

a) jetting one of clean water and air under high pressure for discharging slime through the slime discharge pipe.

13. A method of forming modified ground as defined in claim 8, wherein:

a) said maintaining the slurry pressure substantially constant is carried out by providing one of a clear water jet hole and an air jet hole for jetting one of clean water and air under high pressure.

14. A method of forming modified ground as defined in claim 8, further comprising:

a) opening the jet nozzle and the slime suction hole during said initiating a hardening agent jet.

* * * * *